US007708648B2

(12) United States Patent
Brunton et al.

(10) Patent No.: US 7,708,648 B2
(45) **Date of Patent: *May 4, 2010**

(54) GOLF TRAINING DEVICE

(75) Inventors: Henry Brunton, King City (CA); Robert G. Dickie, King City (CA); Qian Wang, King City (CA)

(73) Assignee: Brunton Innovations Inc., King City, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/168,617

(22) Filed: Jul. 7, 2008

(65) Prior Publication Data

US 2008/0268974 A1 Oct. 30, 2008

Related U.S. Application Data

(63) Continuation-in-part of application No. 11/474,751, filed on Jun. 26, 2006, now Pat. No. 7,537,525.

(51) Int. Cl.
*A63B 69/36* (2006.01)

(52) U.S. Cl. ..... 473/206; 473/220; 473/226

(58) Field of Classification Search ..... 473/201–206, 473/219–223

See application file for complete search history.

(56) References Cited

U.S. PATENT DOCUMENTS 1,664,257 A * 3/1928 Mccullough ..... 473/203
2,484,762 A 10/1949 Strazza
2,628,100 A 2/1953 Beebe
3,227,455 A 1/1966 Hulsman
3,253,829 A 5/1966 Ford
3,256,023 A 6/1966 Frazelle
3,806,130 A 4/1974 Jacques
4,167,268 A 9/1979 Lorang
4,884,813 A 12/1989 Cates
5,152,533 A 10/1992 Radakovich
5,228,695 A 7/1993 Meyer
5,439,217 A 8/1995 Ganger, Sr.
5,524,892 A 6/1996 Karp
5,605,509 A 2/1997 Gray
5,681,993 A * 10/1997 Heitman ..... 73/379.02
5,762,563 A 6/1998 Holzhausen
5,788,582 A * 8/1998 Shapiro ..... 473/220
5,897,441 A 4/1999 Apthorp
5,984,795 A 11/1999 Stafford
6,705,951 B2 3/2004 Beauregard (Continued)

FOREIGN PATENT DOCUMENTS

DE 3720054 12/1988

(Continued)

*Primary Examiner*—Nini Legesse
(74) *Attorney, Agent, or Firm*—Sand & Sebolt

(57) ABSTRACT

A golf training device comprising an elongate member with a first positioning aid having an indicator thereon that is visually alignable with a portion of the club. When the indicator is so aligned, the training device is used to correctly position the golfer's hands around the circumference of the club handle. The training device includes additional aids to enable the golfer to correctly position the device linearly on the grip and to then correctly position his or her fingers and thumbs around the training device. The training device may further include pressure sensors and a speaker to aid the golfer in learning to grip the club correctly.

29 Claims, 21 Drawing Sheets

U.S. PATENT DOCUMENTS

| | | | |
|---|---|---|---|
| 6,921,340 | B2 | 7/2005 | Dickie |
| D520,091 | S | 5/2006 | Leadbetter et al. |
| 7,252,596 | B1 | 8/2007 | Matousek |
| 2002/0151373 | A1 | 10/2002 | Beauregard |
| 2007/0298899 | A1 | 12/2007 | Wang |

FOREIGN PATENT DOCUMENTS

| | | |
|---|---|---|
| GB | 322512 | 12/1929 |
| GB | 2386326 | 9/2003 |
| JP | 08243201 | 9/1996 |
| WO | 9727913 | 8/1997 |
| WO | 02094388 | 11/2002 |

* cited by examiner

GOLF TRAINING DEVICE

BACKGROUND OF THE INVENTION

1. Technical Field

This invention generally relates to training devices for athletes and players. More particularly, the invention relates to a training device for golfers. Specifically, the invention relates to a training device that is attachable to a golf club handle to enable a golfer to perfect the position of their grip on the club and the pressure with which they engage the grip, and to simultaneously train themselves to accurately play a stroke in a particular direction.

2. Background Information

It is the opinion of some professional golfers that most amateur golfers grip their golf clubs improperly and this tends to impede the accuracy of their swing. The grip needs to be corrected before the amateur golfer can really work on their swing and see substantial improvement. However, the golfer may have used his or her improper grip for many years and a few hours lessons with a golf professional cannot correct years of improper habit. A number of devices and training methods have been proposed in the prior art to aid in correcting the grip on the club handle. A number of these training devices assist the golfer in holding the club correctly while the aid is attached to the club, but as soon as the aid is removed, the golfer returns to their old habits. If the golfer is able to play many games over a period of time with a suitable training device, the golfer's muscle memory would be reset and corrected and the training device would only be required occasionally to verify that the golfer's grip has been corrected.

There is therefore a need in the art for an improved golf training device that will enable a golfer to position their hands on the club handle correctly and will, over the course of time, retrain the golfer's muscle memory to maintain the correct grip on the handle even when the training device is removed therefrom.

SUMMARY OF THE INVENTION

The device of the present invention is a golf training device that includes a first positioning aid having an indicator that is visually alignable with a portion of the club. When the indicator is so aligned, the training device is used to correctly position the golfer's hands around the circumference of a club handle. The device further aids in setting the correct interrelationship between the golfer's upper and lower hands and correctly sets the rotation of the hands to the heel of the golf club head. The training device further corrects the placement of the golfer's hands along the linear axis of the club and aids in training the golfer to apply the correct pressure to the golf grip throughout their swing.

A first embodiment of the training device is designed for use on full-swing clubs such as irons and drivers. This first embodiment incorporates a pop-up rotation gauge to assist in setting the training device at a neutral position. The second embodiment of the training device is designed for use on clubs that will not pass through a full swing, specifically putters. All putter grips have a planar section that is aligned with the club face. The training device for putters has a corresponding planar section to automatically align the training device to the neutral position. The second embodiment does not have a pop-up rotation indicator.

Each of the first and second embodiments of the present invention may include one or more electronic pressure sensors that will generate an audible sound through a speaker when the pressure exerted by the golfer's fingers exceeds a preset limit.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
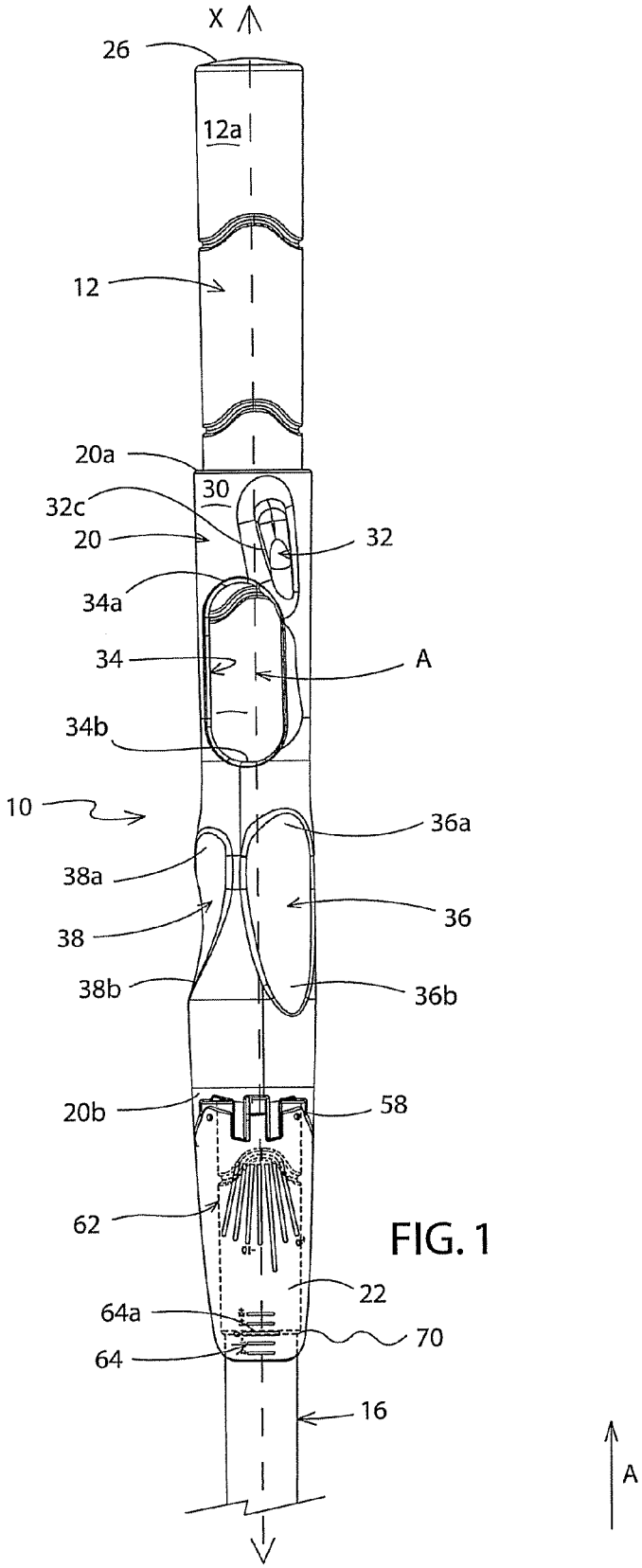
FIG. 1 is a front view of a golf training device in accordance with the present invention engaged with the handle of a full-swing golf club.

Referring to FIGS. 1-13 there is shown a golf training device in accordance with the present invention and generally indicated at 10. Training device 10 is designed to be used on a golf club 14. Club 14 includes a head 18, a shaft 16 and a grip 12. Grip 12 has an uppermost end 26 and an innermost end 70 and is generally circular in cross-sectional shape. Grip 12 therefore has a circumferential component and a linear component. The linear component is generally aligned with the longitudinal axis "X" of club 14. The circumferential component is generally at right angles to the longitudinal axis "X" of club 14.

The training device 10 in accordance with the present invention is designed to be engaged around the exterior surface 12 of the pre-existing grip 12 of club 14. Training device 10 is not permanently affixed to grip 12 but is temporarily engageable therewith when the golfer wishes to practice his or her game. Specifically, training device 10 is designed to aid the golfer in correctly positioning their upper and lower hands on grip 12. The term "upper hand" as used herein is meant to identify the one of the golfer's hands that is closest to the uppermost end 26 of club 14. The term "lower hand" as used herein is meant to identify the one of the golfer's hands that is closest to the head 18 of club 14. Specifically, training device 10 is designed to aid the golfer to correctly place their fingers around the circumference of the grip 12. Furthermore, training device 10 is designed to aid the golfer to correctly position the fingers and thumb of their upper hand in relationship to the fingers and thumb of their lower hand. Still further, training device 10 is provided to correct the rotation of both upper and lower hands relative to the heel of the golf club head. The upper and lower hands may have a strong, weak or neutral grip rotation and only the neutral rotation is correct. Training device 10 is designed to aid the golfer in having this neutral rotation. Training device 10 is additionally designed to aid in teaching the golfer to correctly position their hands along the longitudinal axis of the golf grip and to apply the correct pressure to the grip throughout the swing of club 14.

In accordance with the present invention, training device 10 comprises a body 20 that is molded to include components that will aid the golfer in correctly positioning both the upper and lower hands, and more specifically to correctly position the fingers and thumbs thereof. Body 20 is provided with a first positioning aid in the form of a pop-up member 22. Pop-up member 22 is used to correctly position the training device on the circumference of grip 12 so that training device 10 and therefore the golfer's hands are correctly positioned relative to a portion of the club. Specifically, pop-up member 22 enables the golfer to engage training device 10 on grip 12 in a neutral position relative to the heel of the club.

Preferably, body 20 is manufactured from a flexible plastic such as polypropylene and pop-up member 22 is manufactured from a clear plastic such as a polycarbonate so that an indicator on pop-up member 22 can be visually aligned with a portion of club 14. Pop-up member 22 is pivotably mounted onto body 20 as will be hereinafter described and is movable between a play position, shown in FIGS. 1-3, and a set-up or non-play position, shown in FIGS. 7 and 8.

Body 20 has a proximal end 20*a* and a distal end 20*b* and is of a length ""L" as measured between proximal and distal ends 20*a*, 20*b*. Body 20 also has a longitudinal axis "X" that extends between proximal and distal ends 20*a*, 20*b* and is substantially alignable with the longitudinal axis "Y" (FIG. 2) of golf club 14. Body 20 further has a first and a second side edge 20*c*, 20*d* that are spaced a distance away from each other and are generally equidistant from a centerline "A" (FIG. 6) of said body 20. Centerline "A" is generally parallel to the longitudinal axis "X" and when body 20 is engaged on grip 12, the longitudinal axis "X" of body 20 is generally coaxial with the longitudinal axis "Y" of golf club 14.

Body 20 is a thin, flexible member that is substantially C-shaped in cross-section and has an interior surface 28 and an exterior surface 30. At least interior surface 28 is configured to be complementary in cross-sectional shape to a portion of the circumferential exterior surface 12*a* of grip 14 and to be frictionally engaged therewith. Exterior surface 30 is molded with contoured features that designate the correct positions and orientations for the golfer's thumbs and fingers, and therefore the correct positions for both the upper and lower hands.

The first of such contoured features provided on body 20 is a protrusion 32 that extends upwardly and outwardly away from exterior surface 30. Protrusion 32 is useful for positioning the thumb of the upper hand. Protrusion 32 is disposed proximate to proximal end 20*a* and may be disposed immediately adjacent proximal end 20*a* or spaced a distance inwardly therefrom. As shown in FIG. 1, protrusion 32 preferably is oriented at an acute angle relative to centerline "A" with a first end 32*a* thereof disposed closer to centerline "A" and a second end 32*b* disposed further away therefrom. Protrusion 32 thus angles away from centerline "A" and toward one of first and second side edges 20*c*, 20*d*. The training device illustrated in FIGS. 1-13 is designed for use by a right-handed male golfer. Consequently, protrusion 32 angles away from centerline "A" and toward first side edge 20*c*. If the training device were designed for a left-handed golfer, which is not shown, the protrusion would angle away from centerline "A" and toward second side edge 20*d*. Protrusion 32 is formed with gently rounded edges so that it is comfortable for the golfer to position the side of his or her thumb thereagainst. Specifically, protrusion 32 has a gently rounded inner side wall 32*c* that acts as a rest for the inner side of the thumb of the golfer's upper hand and substantially prevents lateral motion of that thumb. Protrusion 32 extends outwardly away from exterior surface 30 for a distance that is sufficient to prevent the golfer's thumb from accidentally riding vertically over protrusion 32 when a stroke is played.

A second feature provided on training device 10 for correct placement of the golfer's hands is an aperture 34. Aperture 34 is an elongate oval shape that is defined in body 20 in such a manner that it is generally oriented substantially parallel to longitudinal axis "X" and extends for a distance generally along centerline "A". Aperture 34 extends through both of the exterior and interior surfaces 30, 28 so that when a golfer positions his thumb therein, the thumb comes into direct contact with the exterior surface 12*a* of grip 12. Preferably, and as shown in FIG. 1 herewith, aperture 34 is defined such that a first end 34*a* thereof is disposed adjacent protrusion 32. Preferably, first end 34*a* is situated intermediate the first and second ends 32*a*, 32*b* of protrusion 32 or is at least adjacent second end 32*b* thereof. A second end 34*b* of aperture 34 is disposed a distance away from second end 32*b* of protrusion 32 and further inwardly from end 20*a* of body 20. Thus, second end 32*b* of protrusion 32 is a greater distance away from end 20*a* of body than is second end 32*b* of protrusion 32. Preferably, second end 34*b* of aperture 34 is proximate a midpoint of the length "L" of body 20.

Body 20 is further provided with one or more other contoured features to aid in correct placement of the fingers and thumbs. Specifically, body 20 is further provided with a first pad 36 for placement of the thumb of the lower hand. In this instance, because training device 10 is designed for use by a right-handed male golfer, first pad 36 is for placement of the right thumb. First pad 36 may be formed as a groove in exterior surface 30 or a contoured region that is clearly delineated in some way so that the golfer can easily identify the same. Body 20 further includes a second pad 38 for placement of a portion of the side of the right index finger. Additionally, body 20 includes a third pad 40 for receiving the tip of the index finger of the lower hand. Pads 36, 38 and 40 are formed in a region of device 10 that is contoured so that it is raised outwardly relative to the region surrounding and defining aperture 34. First pad 36 is generally oval-shaped and extends generally parallel to longitudinal axis "X". First pad 36 has a first end 36*a* that is spaced a distance away from second 34*b* of aperture 34 and a second end 36*b* disposed a distance from first end 36*a*. First end 36*a* is also disposed proximate centerline "A" and first pad 36 extends outwardly from centerline "A" and toward first side edge 20*c*.

Second pad 38 is generally oval in shape and extends generally parallel to the longitudinal axis "X". Second pad 38 has a first end 38*a* disposed a spaced distance from second end 34*b* of aperture 34 and proximate centerline "A". First end 38*a* of second pad 38 is disposed generally adjacent first end 36*a* of first pad 36. First end 38*a* of second pad 38 preferably is spaced further from second end 34*b* of aperture 34 than is first end 36*a* of first pad 36. Furthermore, second pad 38 extends outwardly from centerline "A" and toward second side edge 20*d*. Consequently, second ends 36*b*, 38*b* are spaced laterally further apart from each other than are the first ends 36*a*, 38*a*. A ridge 42 is formed intermediate first pad 36 and second pad 38 with the ridge 42 being generally aligned with longitudinal axis "X". Ridge 42 does not extend outwardly beyond protrusion 32 but is still raised relative to the adjacent portion of body 20.

Third pad 40 is disposed adjacent first side edge 20*c* and extends upwardly toward first pad 36, preferably terminating a short distance away therefrom. Third pad 40 is oriented such that it angles generally from centerline "A" outwardly toward first side edge 20*c*.

It will be understood that protrusion 32, aperture 34, first, second and third pads 36, 38 and 40 are all provided so that when golfer holds club 14 and places the appropriate fingers and thumbs on, in and against these features, their fingers and thumbs, and therefore their hands, will be correctly positioned around grip 12 and will be correctly oriented relative to each other.

Pop-up member 22 is provided to enable the golfer to set the position of his or her hands so that the correct rotation relative to the heel of the club is attainable. Pop-up member 22 preferably is pivotably secured to distal end 20*b* of body 20. Distal end 20*b* includes a pair of spaced-apart buttresses 44 that are separated from each other by a gap 46. Each buttress 44 defines a hole 48 therein and the pair of holes 48 are aligned with each other and are oriented substantially at right angles to the longitudinal axis "X" of body 20. Pop-up member 22 includes a boss 50 on one end that is separated from a pair of spaced-apart abutments 52 by a pair of spaced-apart slots 54. Slots 54 are complementary in size and shape to buttresses 44 and boss 50 is complementary in size and shape to gap 46. Each abutment 52 defines a hole 56 therein that is oriented substantially at right angles to the longitudinal axis "X" and is alignable with holes 48 in buttresses 44. A pin 58 extends through aligned holes 48, 56 to secure pop-up member 22 to body and a spring 60 is engaged with pin 58. This arrangement permits pop-up member 22 to be pivoted between a play position (FIG. 2) and a non-play position (FIG. 7), as will be hereinafter described. Pop-up member 22 is configured so that the inner end 22*a* thereof is complementary to distal end 20*b* of body 20. Outer end 22*b* of pop-up member 22 is generally arcuate in shape.

In accordance with a specific feature of the present invention, pop-up member 22 is provided with a plurality of first indicator lines 62 and a plurality of second indicator lines 64 thereon. First indicator lines 62 are provided to identify the correct hand position relative to the heel of club 14. First indicator lines 62 identify angles that are useful for the golfer to correctly position training device 10 on the circumference of grip 12 relative to a portion of the club head 18. The lines 62 are useful for positioning training device 10 correctly relative to the heel of the club so that the golfer can hit a substantially straight ball and can correct the tendency to either hook or slice a ball. First indicator lines 62 include a first line 62*a* that indicates a neutral position or an angle of zero degrees. First indicator lines 62 also include a plurality of first indicator lines 62*b* that indicate a weak, or negative position relative to the heel of the club as is signified by the negative angle identifiers 63 associated with lines 52. Each line 62*b* as illustrated indicates an angle of an additional negative five degrees off neutral. Finally, first indicator lines also include a plurality of indicator lines 62*c* that indicate a strong, or positive, position relative to the heel of the club as is signified by the positive angle identifiers 65 associated therewith. Each first line 62*c*, as illustrated, indicates an angle of an additional positive five degrees away from neutral. Preferably, pop-up member 22 includes first indicator lines 62 which indicate angles that are as much as 20 degrees positive and 20 degrees negative rotation. The method of using first indicator lines 62 will be described hereinafter.

Second indicator lines 64 are provided on pop-up member 22 to correctly and consistently position training device 10 linearly on grip 12 and relative to axis "Y" of club 14. Second indicator lines 64 include a primary indicator line 64*a*, one or more second lines 64*b* that are provided on a first side of line 64*a* and one or more second lines 64*c* that are provided on the other side of line 64*a*. Second lines 64*b* and 64*c* indicate possible distances away from the primary indicator line 64*a* and are provided with positive and negative markers to identify their position relative to primary indicator line 64*a*.

Figure 2:
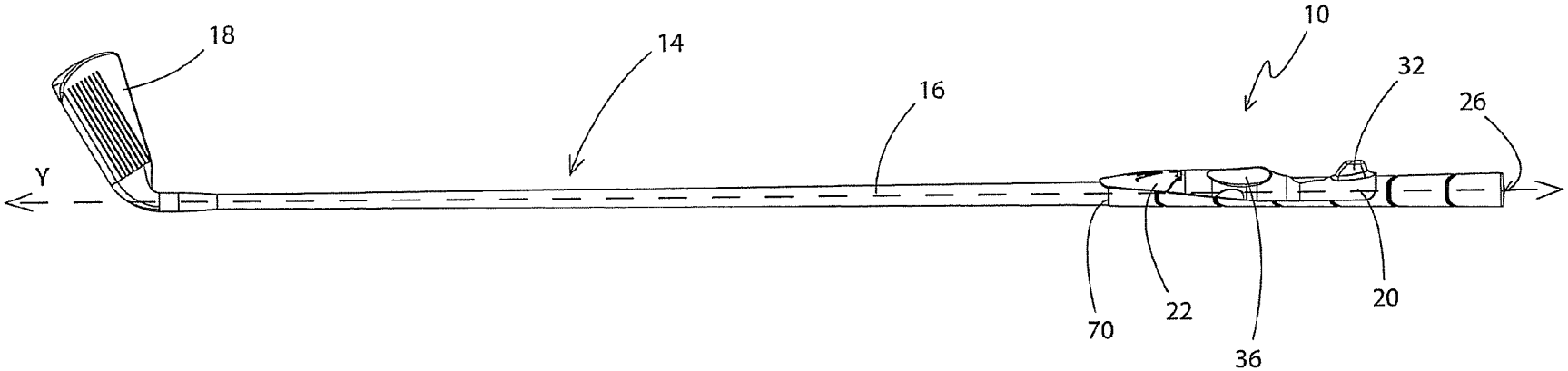
FIG. 2 is a left side view of the golf training device engaged with the golf club and having a pop-up member thereon in a "flipped down" or play position.
Figure 3:
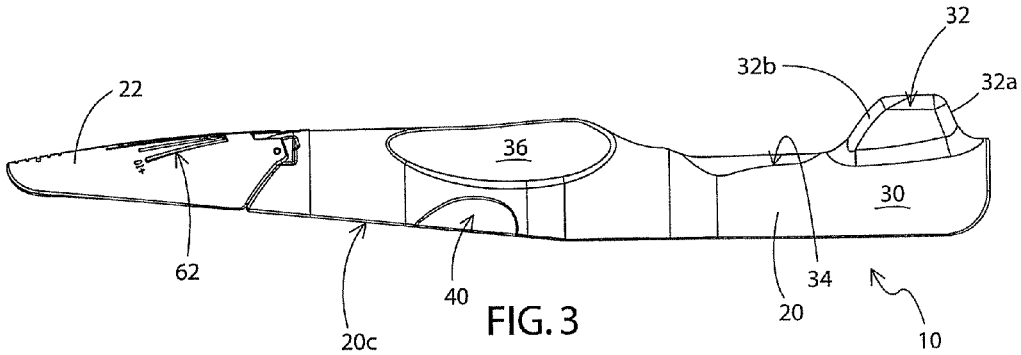
FIG. 3 is a left side view of the golf training device in accordance with the present invention with the pop-up member in the play position.
Figure 4:
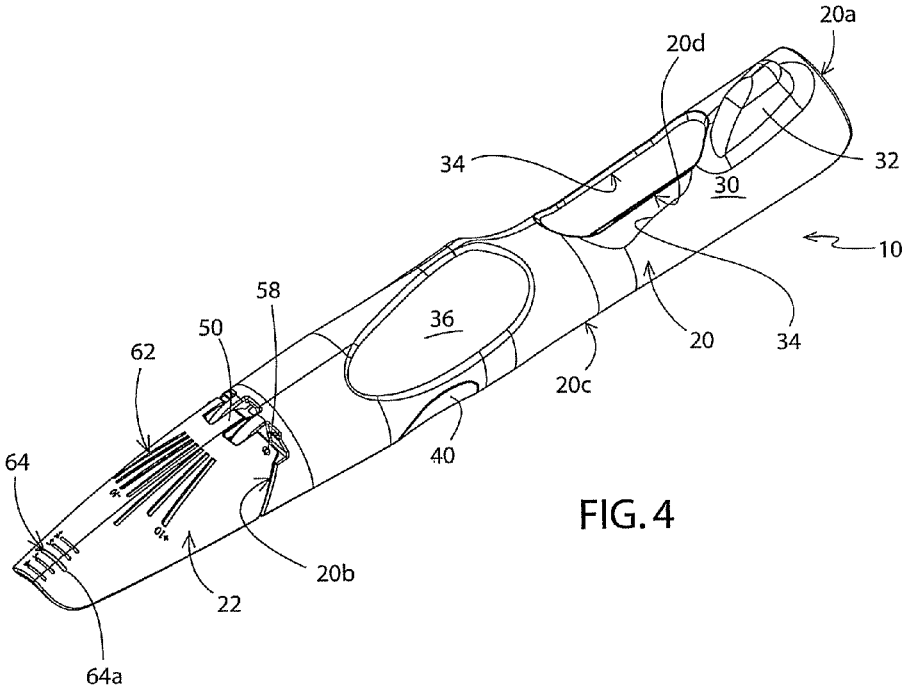
FIG. 4 is a perspective view of the golf training device of FIG. 3.
Figure 5:
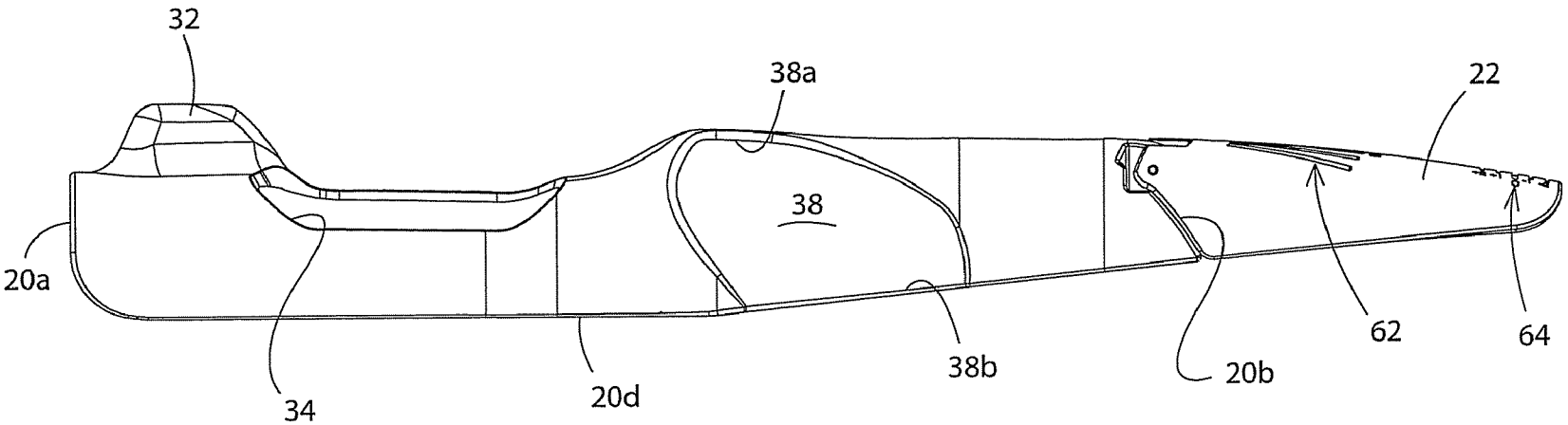
FIG. 5 is a right side view of the golf training device of FIG. 3.
Figure 6:
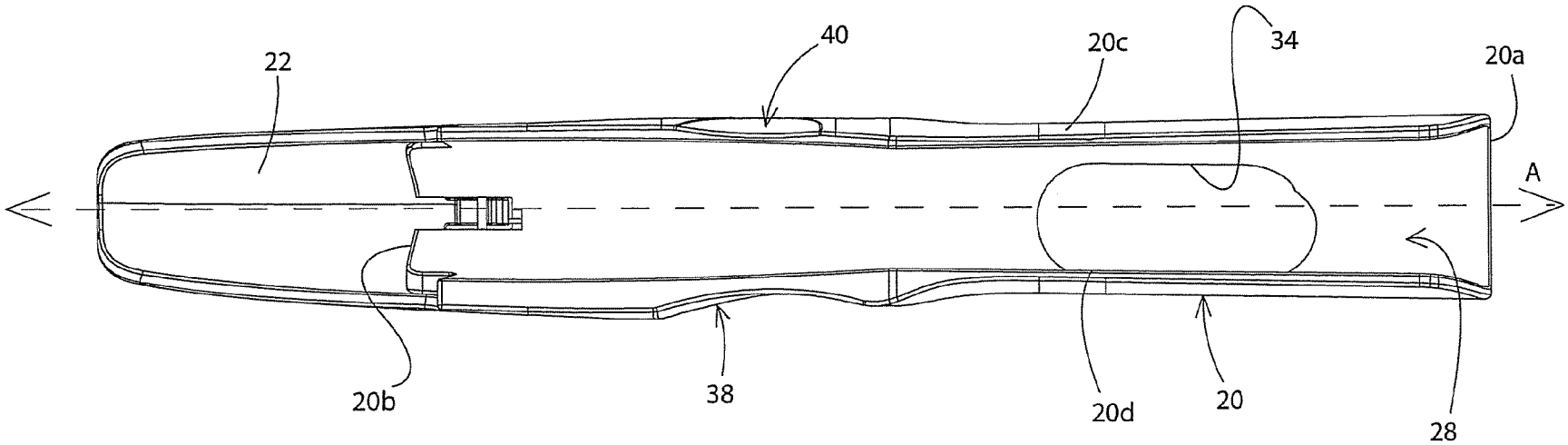
FIG. 6 is a rear view of the golf training device of FIG. 3.
Figure 7:
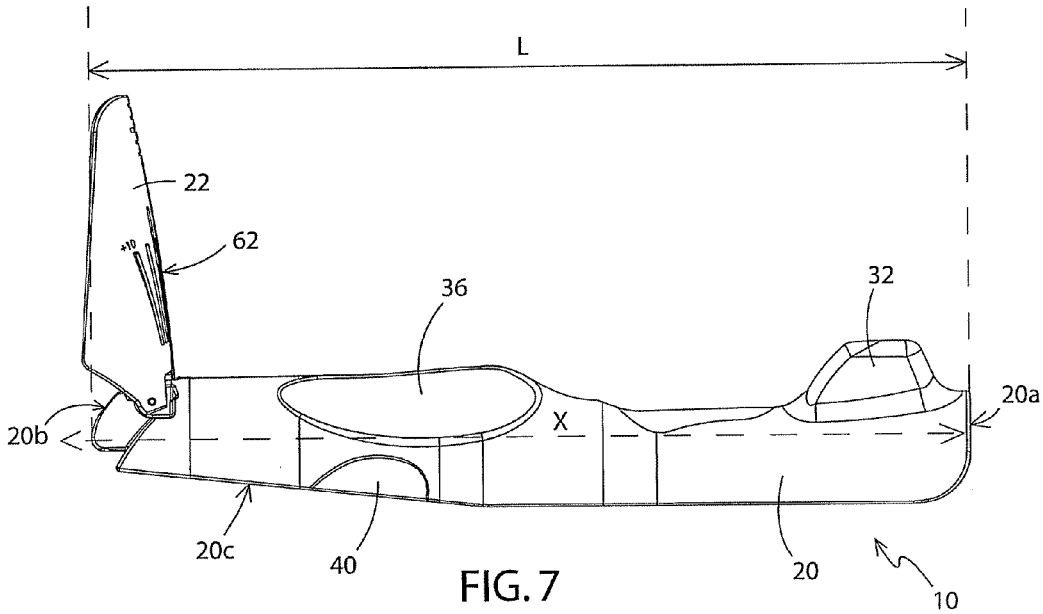
FIG. 7 is a left side view of the golf training device with the pop-up member in a "flipped up" or non-play position.
Figure 8:
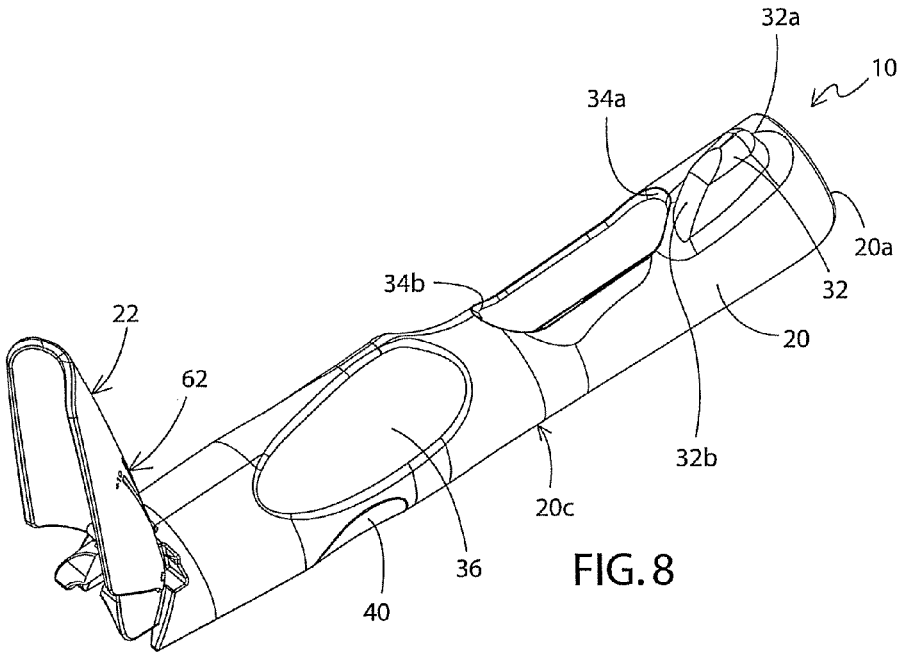
FIG. 8 is a perspective view of the golf training device shown in FIG. 7.
Figure 9:
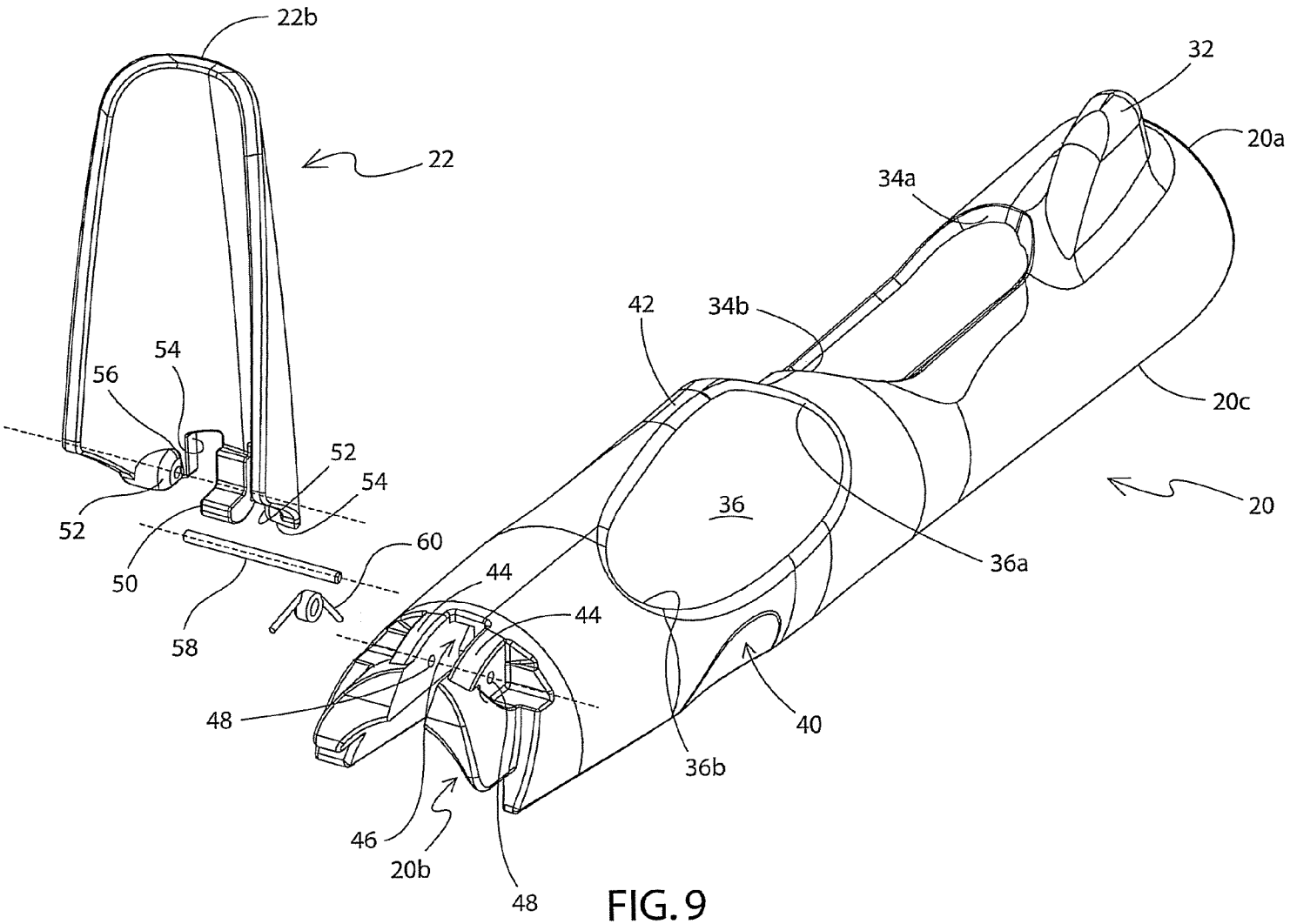
FIG. 9 is a perspective view of the golf training device with the exploded away from the body thereof.
Figure 11:
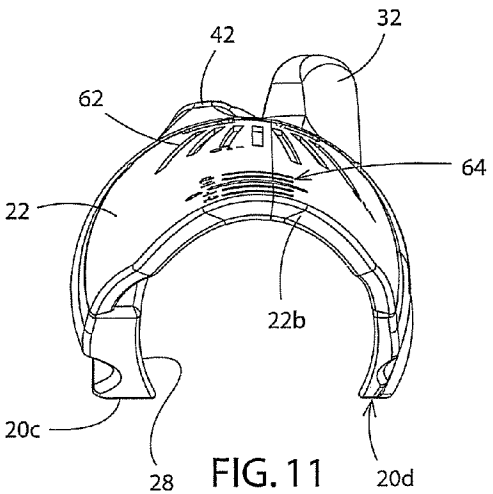
FIG. 11 is a bottom end view of the golf training device with the pop-up member in the play position.
Figure 10:
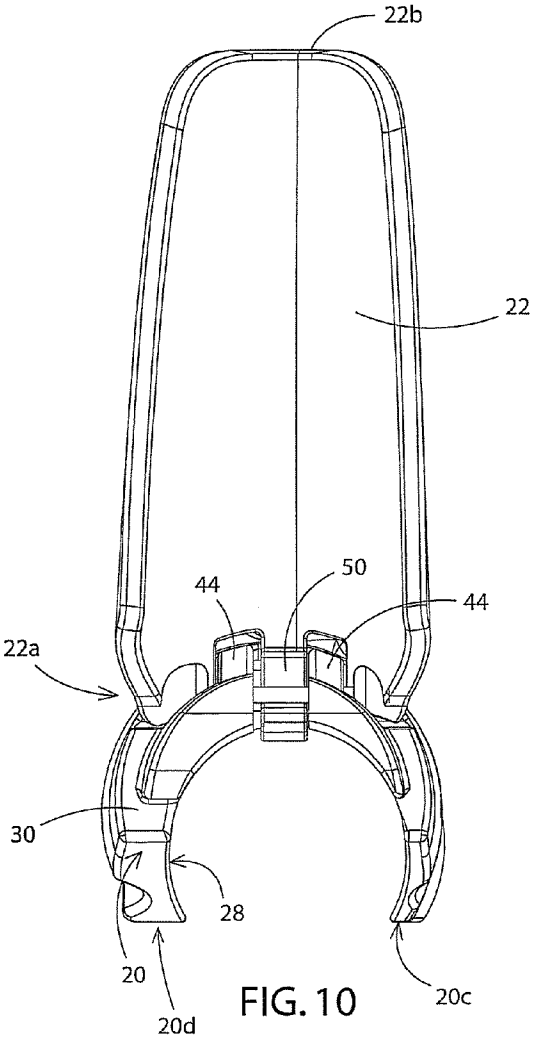
FIG. 10 is a top end view of the golf training device with the pop-up member in the non-play position and showing the connection between the pop-up member and the body.
Figure 12:
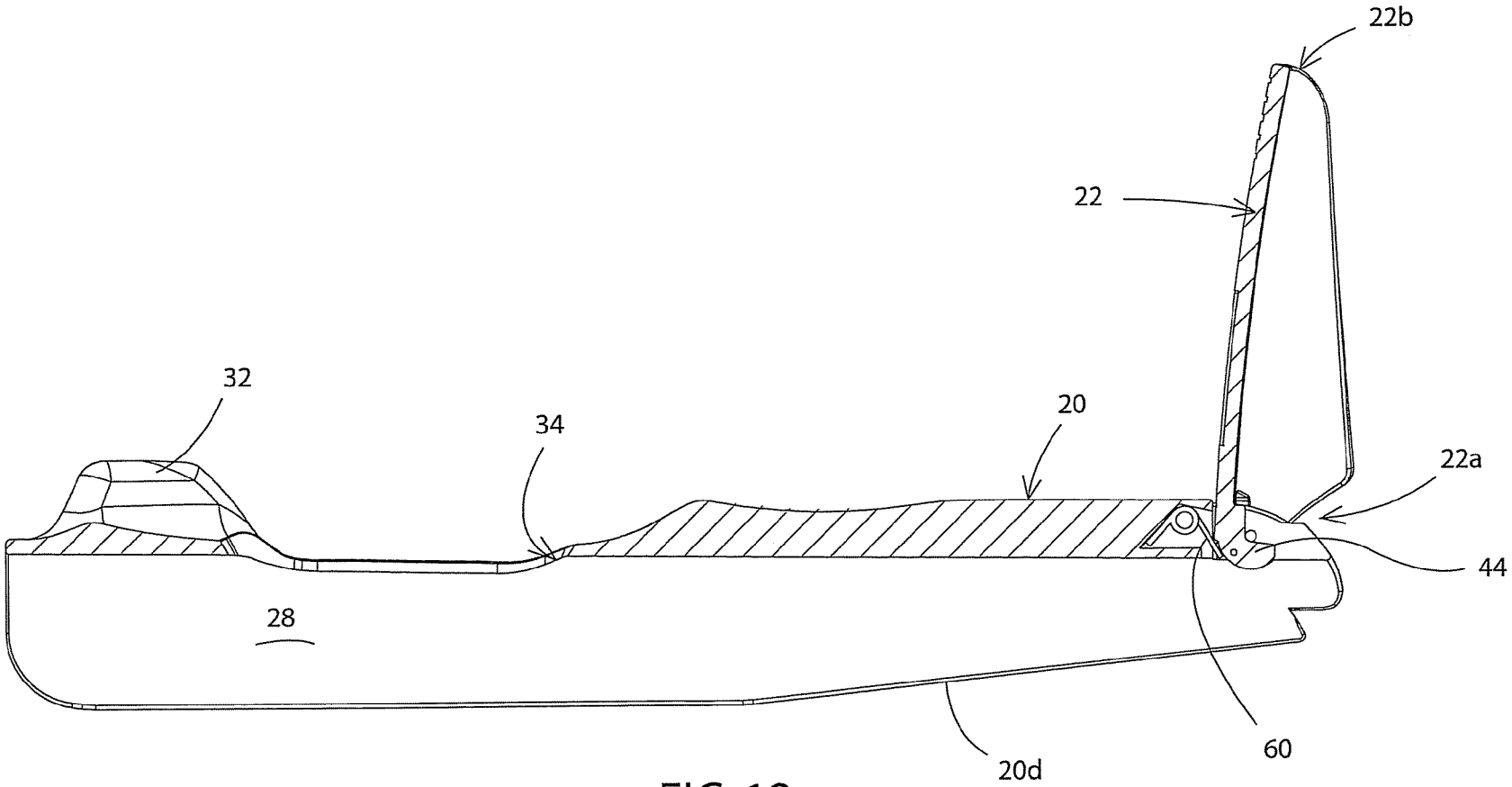
FIG. 12 is a right side view sectional view of the golf training device with the pop-up member in the non-play position.

In order to engage golf training device 10 on grip 12, pop-up member 22 is moved into the play position (FIG. 2). The first end 20*a* of body 20 is positioned adjacent a lower end 70 of grip 12 and body 20 is pushed inwardly to snap-fittingly engage outer surface 12*a* of grip 12. Grip 12 is received within the C-shaped channel formed by interior surface 28 of training device 10. Body 20 is slidingly moved in the direction of arrow "A" (FIG. 1) along exterior surface 12*a* of grip 12 and toward uppermost end 26. Grip 12 is tapered from uppermost end 26 down toward lower end 70. Consequently, as body 20 slides along grip 12, body 20 becomes frictionally engaged therewith and is thereby retained on club 14. Training device 10 is moved in the direction of arrow "A" until primary indicator line 64*a* is aligned with lower end 70 of grip. This places training device 10 at a set and repeatable position on grip 12. Should the golfer decide that he wishes to raise or lower training device 10 on grip 12, training device can be moved in the direction of arrow "A" or in the opposite direction thereto until the desired one of the other second lines 64*b*, 64*c* is aligned with lowermost end 70. The golfer then needs to only remember which of the second lines is aligned with lowermost end 70 to enable him or her to consistently position training device 10 on grip 12. It will be understood that changing the second line that is aligned with lowermost end 70 of grip 12 will adjust the angle of the heel relative to the ground and will therefore change the golfer's swing accordingly.

Figure 13:
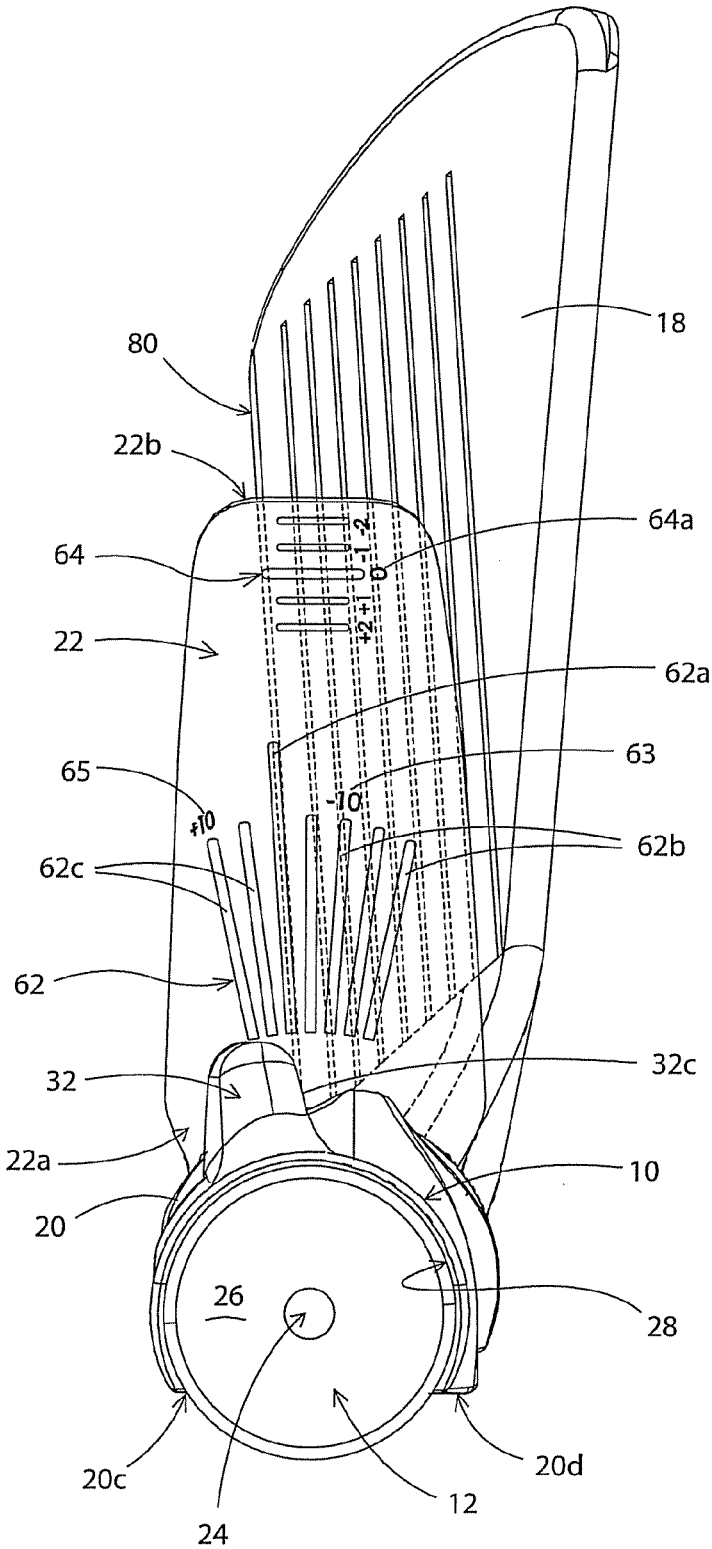
FIG. 13 is a top view of the golf club showing the training device engaged therewith and showing the pop-up member on the training device in a non-play position.
Figure 14:
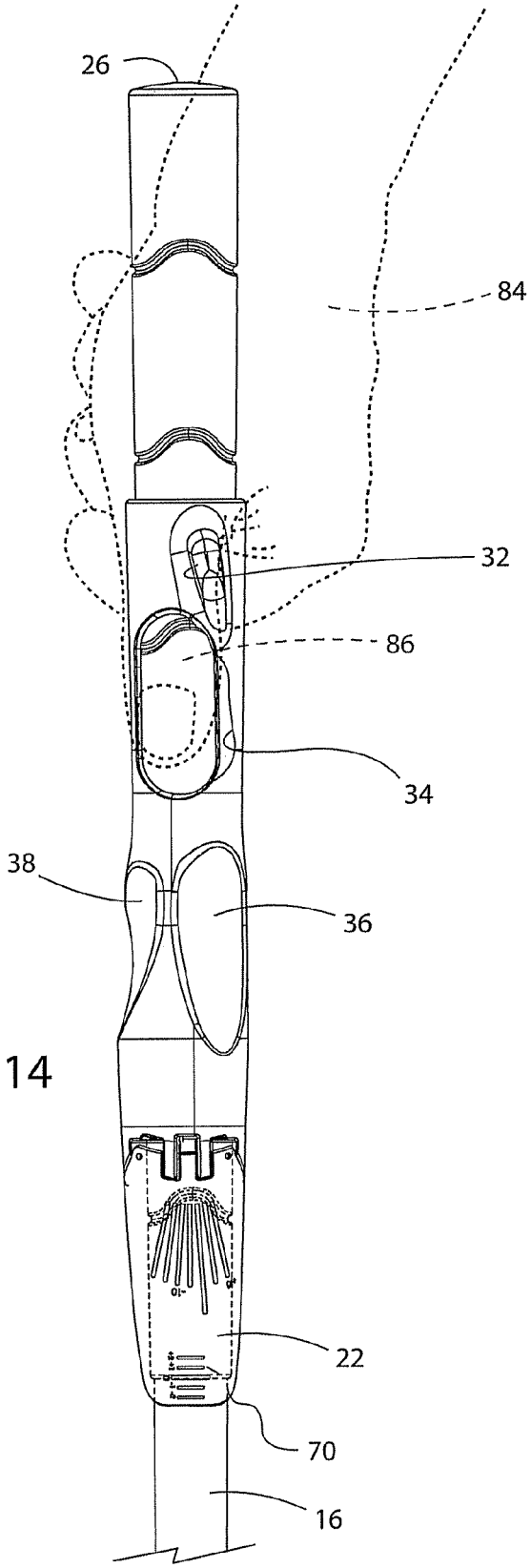
FIG. 14 is a front view of the golf training device engaged on the handle grip and showing the placement of the upper hand of the golfer thereon.
Figure 15:
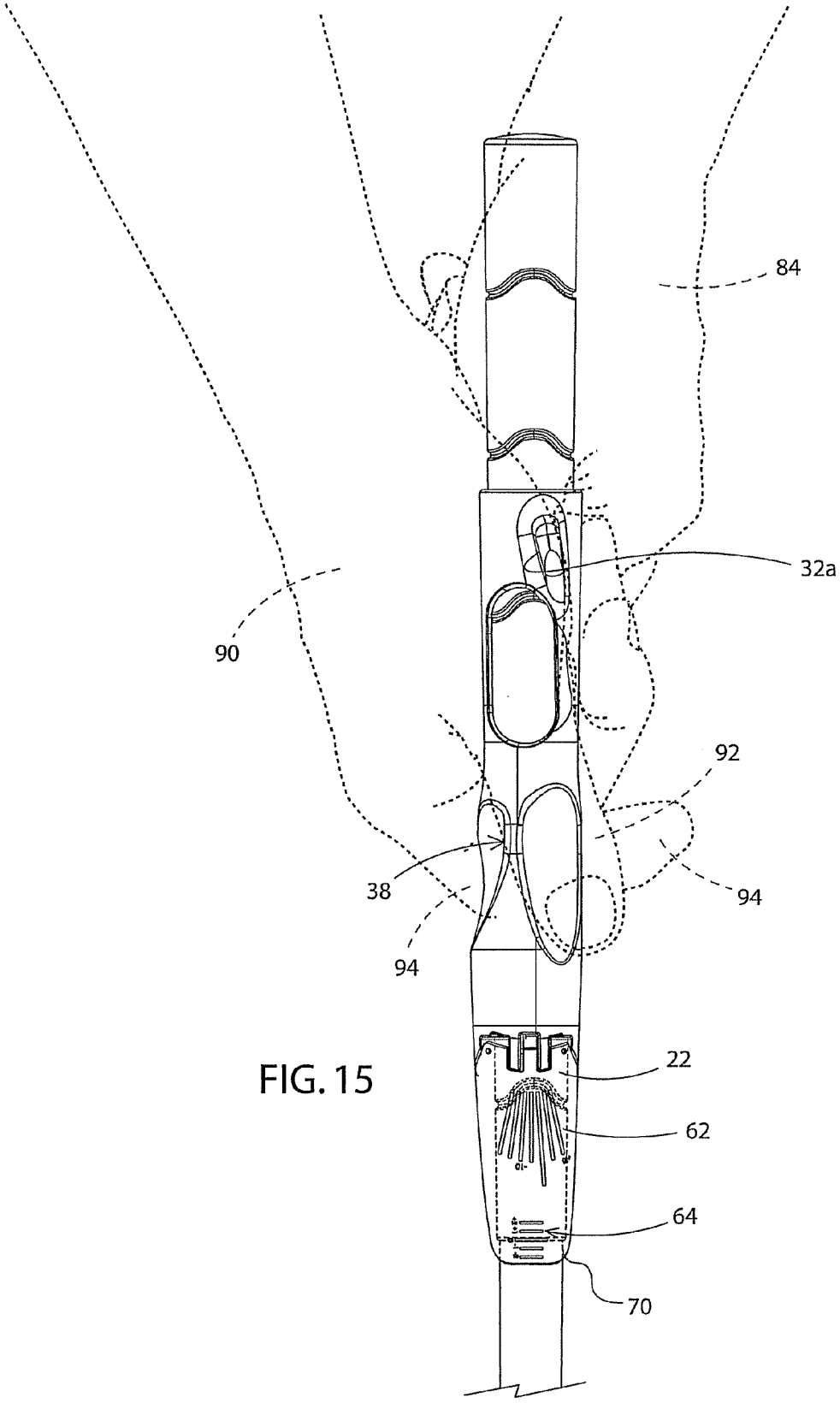
FIG. 15 is a front view of the golf training device of FIG. 14 with the lower hand placed thereon and with the pop-up member in a play position.
Figure 16:
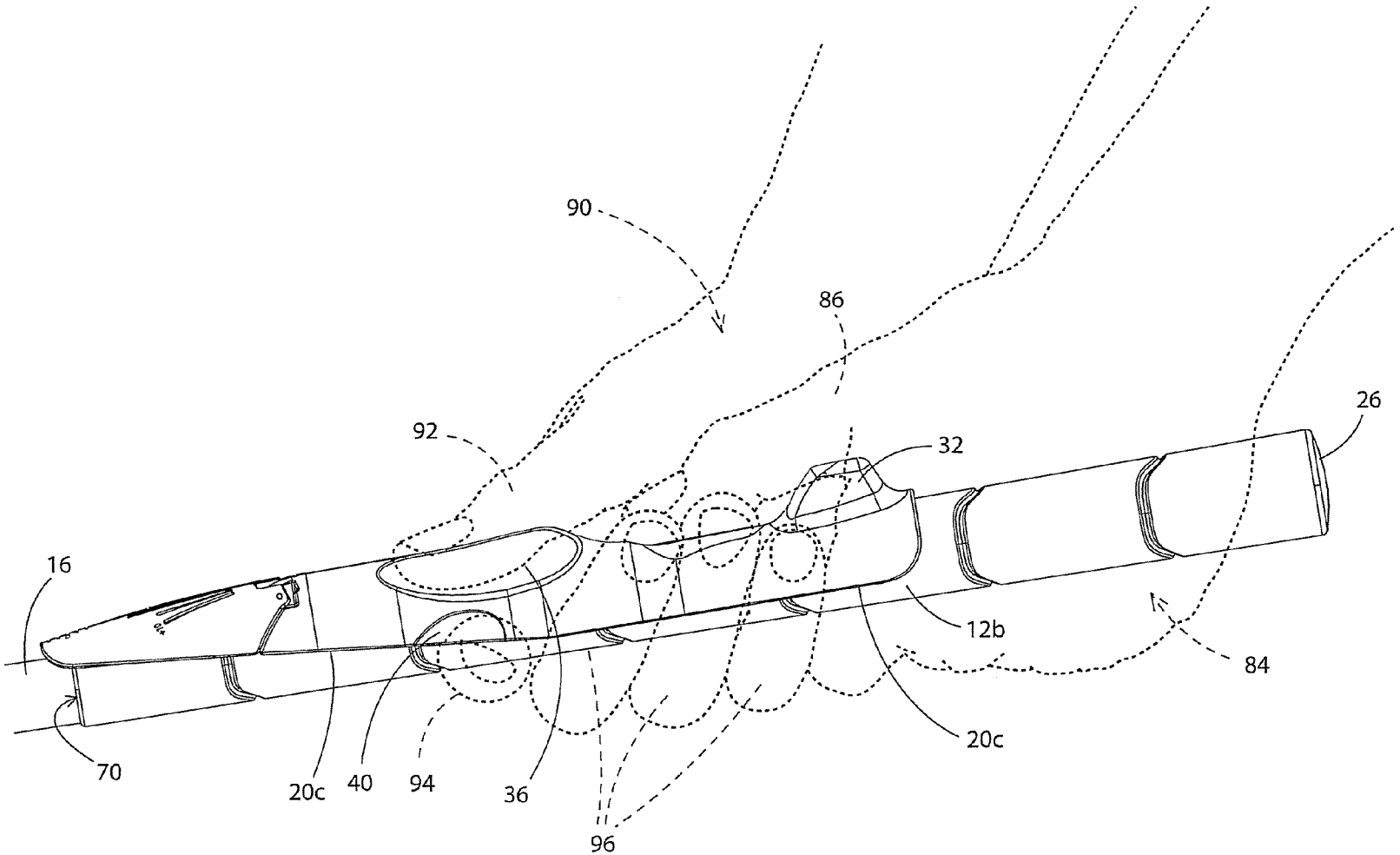
FIG. 16 is a left side view of the golf training device gripped by the upper and lower hands and with the pop-up member in the play position.
Figure 17:
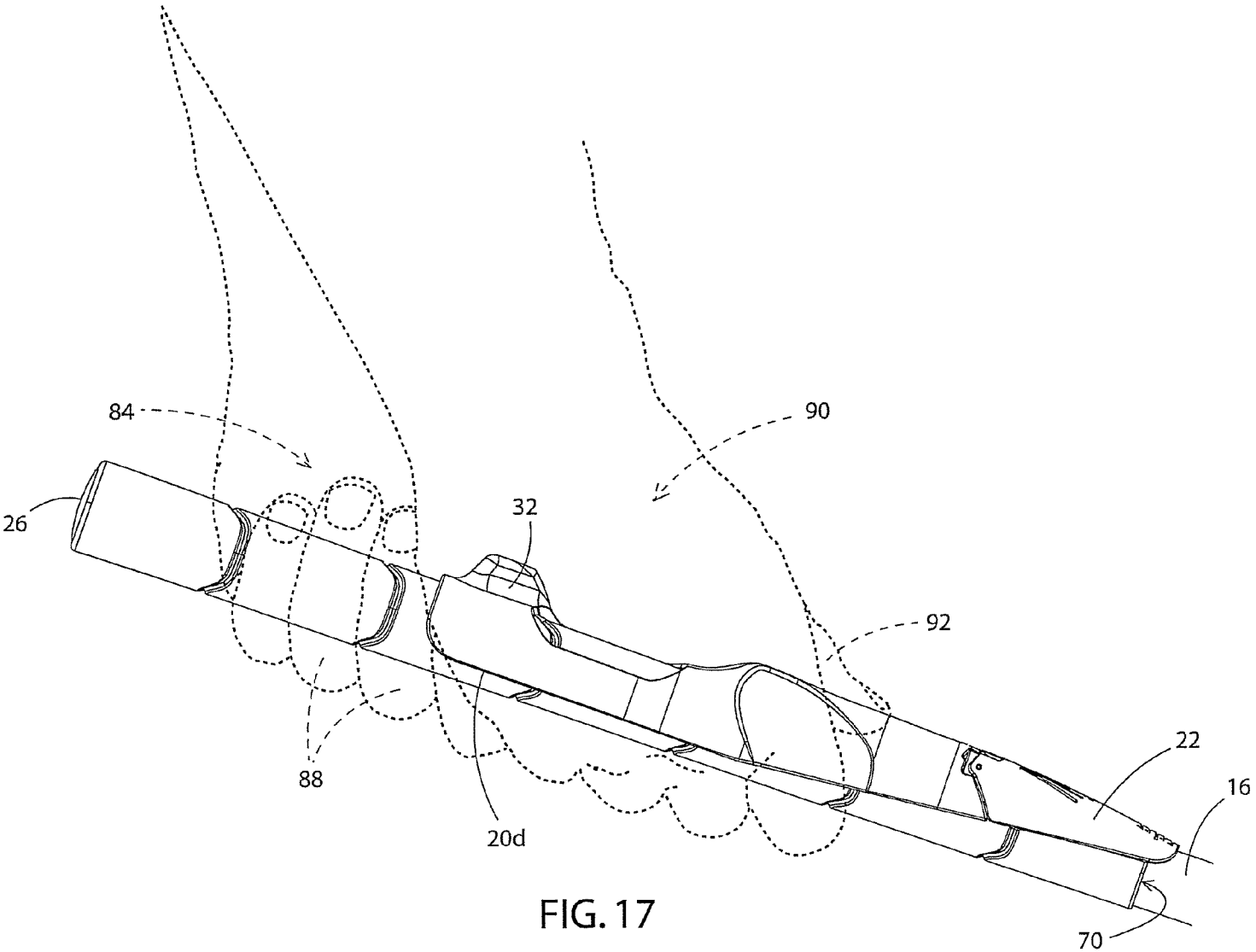
FIG. 17 is a right side view of the golf training device of FIG. 16.
Figure 18:
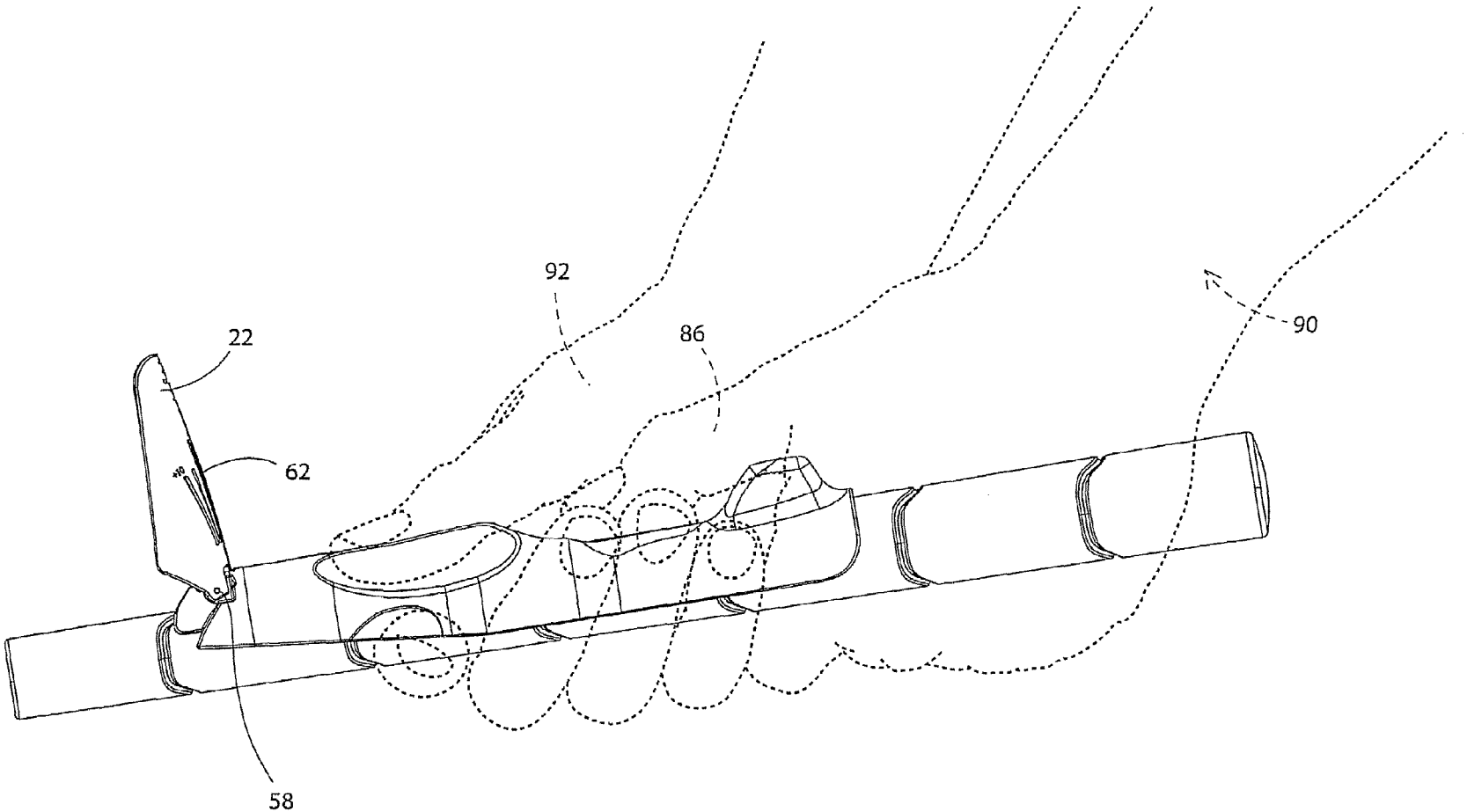
FIG. 18 is a left side view of the golf training device gripped by the upper and lower hands and with the pop-up member in a non-play position.
Figure 19:
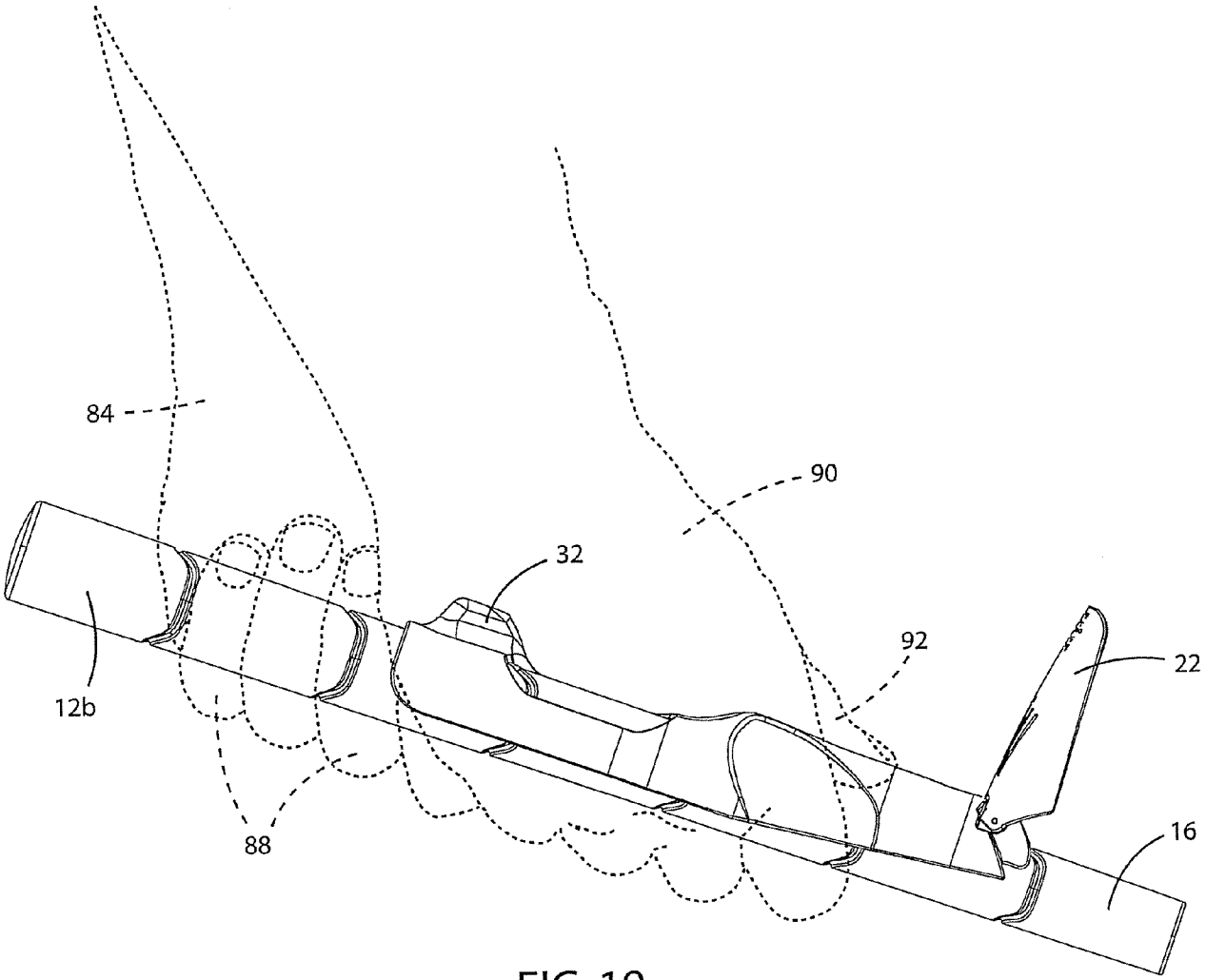
FIG. 19 is a right side view of the golf training device of FIG. 18.
Figure 20:
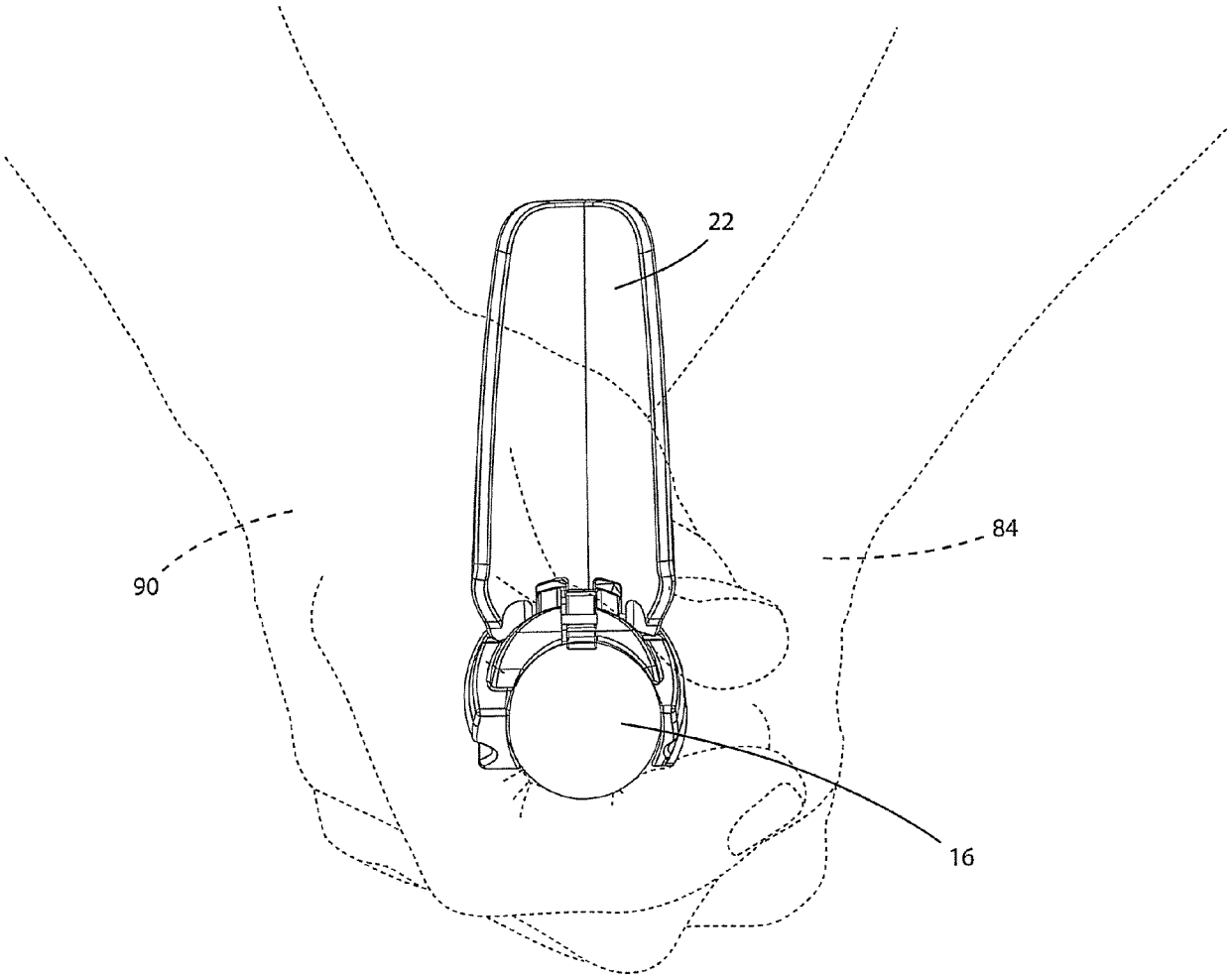
FIG. 20 is a bottom end view of the golf club and golf training device of FIG. 18 where the shaft is cut through a short distance from the training device.

The golfer then has to set the position of the training device 10 on the circumferential surface of grip 12 so that when the golfer holds club 14, the rotation of the golfer's hands relative to the heel of club 14 will be correct. In order to do this, the golfer moves pop-up member 22 from the position shown in FIG. 2 to the position shown in FIG. 7. Pop-up member 22 therefore pivots from the play position where it is substantially coplanar with exterior surface 30 of body, to the non-play position where it is disposed substantially at right angles to exterior surface 30 and to longitudinal axis "X" of body 20. FIG. 13 shows the view the golfer will see when he or she looks at the head 18 of club 14 through the transparent pop-up member 22. Pop-up member 22 includes the plurality of first indicator lines 62 that are selectively alignable with the front face 80 of club head 18. The position of training device 10 on the circumference of grip 12 may be changed by grasping body 20 with one hand and rotating device 10 around at least a portion of the circumference of grip 12. This rotational motion allows the golfer to align any one of the first indicator lines 62 with front face 80 which sets the training device 10 in a particular orientation relative to the heel of the club 14. Consequently, when the golfer positions his or her hands around training device 10, their hands will have a particular orientation relative to the heel of the club and this orientation will affect the way they hit the ball. Preferably, training device 10 should be positioned so that primary first indicator line 62*a* is aligned with front face 80 as shown in FIG. 13. This position of training device 10 on grip 12 places the golfer's hands in the neutral position relative to the heel of club 14. When the golfer grips the club and strikes the ball when his or her hands are in this neutral position, the flight of the ball should be straight and true.

Training device 10 may, alternatively, be positioned on the circumference of the grip 12 so that another of the first indicator lines 62*b*, 62*c* is aligned with front face 80. This is accomplished by rotating body 20 around the circumference of grip 12 in one of two directions until the desired one of the other indicator lines 62*b* or 62*c* is aligned with the face 80 of the club. This different one of the first indicator lines 62*b*, 62*c* could be selected to correct a known problem in the golfer's game. So, for example, if the golfer knows that he or she habitually slices or hooks the ball, they will position the training device 10 so that an appropriate one of the first indicator lines 62*b* or 62*c* is aligned with front face 80. Then, when they grasp club 14, their hands will be positioned and oriented differently to the way they would normally grip the club and the slicing or hooking of the ball will be at least somewhat corrected. If the hooking or slicing issue is not adequately addressed, the golfer can adjust the position of training aid 10 on grip 12 once again to bring another of lines 62*b*, 62*c* into alignment with front face 80. This will again change the position of the golfer's hands relative to the heel of the club and will assist in correcting their tendency to hook or slice the ball. When training device 10 is positioned so that the golfer hits the ball straight instead of hooking or slicing the same, then the golfer may note which one of the first indicator lines 62*b*, 62*c* is aligned with front face 80 and can then consistently place the training device 10 in that position when they practice. Over a period of time, the tendency to hook or slice a ball will tend to disappear from their game.

Once pop-up member 22 has been used to correctly position training device 10 circumferentially on grip 12 and relative to club head 14, the golfer pivots pop-up member 22 from the non-play position into the play position. The golfer places his or her hands around training device 10 and grip 12 in order to hold club 14. Because the figures illustrate a right-handed golfer gripping club 14, the golfer positions his or her left hand (the upper hand) 84 first on training device 10. This is done by placing the left thumb 86 in aperture 34 so that the surface of left thumb 86 rests on the exterior surface 12*a* of grip 12. The inner side region of left thumb 86 is positioned so that it abuts surface 32*a* of protrusion 32. The golfer wraps the fingers 88 of his or her left-hand 84 around the uncovered region 12*b* of grip 12 and possibly back into partial contact with a side region of body 20 adjacent second side edge 20*d*. The right or lower hand 90 is then positioned around training device 10 and grip 12. This is accomplished by placing the right thumb 92 onto first pad 36 and placing the right index finger 94 onto second pad 38 and wrapping it around grip 12 until the tip thereof rests in third pad 40. The remaining fingers 96 of right-hand 90 wrap around the uncovered region 12*b* of grip 12 and back into contact with training device 10 in the region of first side edge 20*c*. Training device 10 has hereby correctly positioned the hands 84, 90, thumbs 86, 92 and fingers 88, 94, 96 on grip 12 and the golfer may now use club 14 to play the stroke. Because training device 10 was correctly positioned relative to the heel of the club prior to the golfer positioning their hands, the rotation of the hands relative to the heel is preset and is repeatable. Consistent use of training device 10 will retrain the golfer's muscle memory and ultimately, through repetitive use, the golfer will correctly grip his club 14 and will play a much improved game.

Figure 26:
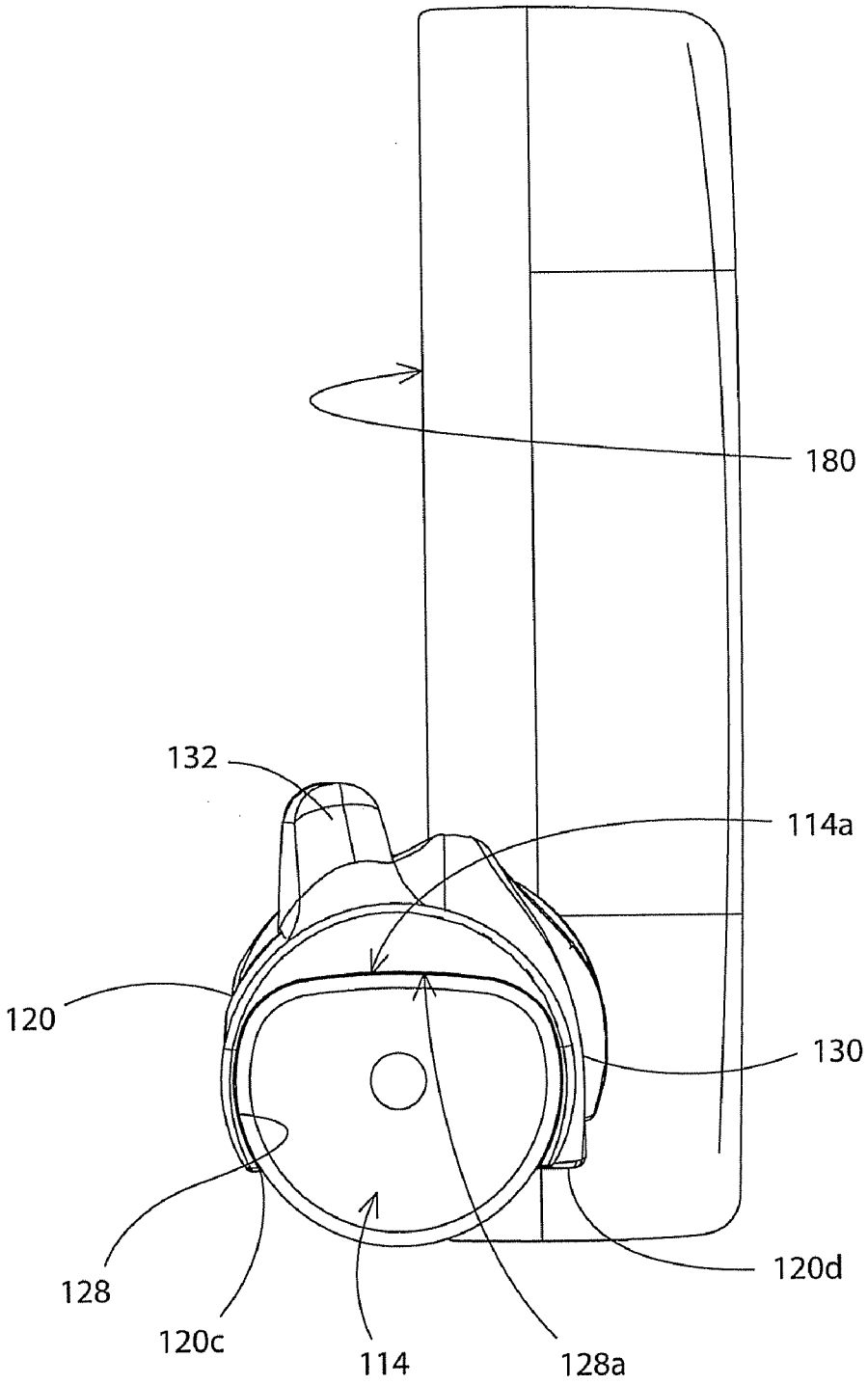
FIG. 26 is a top view of the golf putter showing the second embodiment of the golf training device engaged therewith and showing the planar surface on the training device being complementary configured and seated on a planar face of the putter's grip.

Referring to FIGS. 21-26, there is shown a second embodiment of a training device in accordance with the present invention and generally indicated at 110. Training device 110 is designed for use in association with non-full-swing golf clubs such as a putter 114. Training device 110 comprises a body 120 having a proximal end 120*a*, a distal end 120*b*, first and second side edge 120*c*, 120*d* and interior and exterior surfaces 128, 130. As shown in FIG. 26, putters 114 are manufactured with a planar face 114*a* that is oriented substantially at right angles to the putting face 180 thereof. Body 120 of training device 110 is designed to be configured complementary to grip 112 on putter 114 and specifically to be configured so that it has a positioning indicator that automatically sets body 20 in a neutral position relative to the heel of the putter 114. To that end, interior surface 128 is provided with a positioning indicator in the form of a planar face 128*a* complementary to planar face 114*a* of putter 114. Thus, there is only one orientation by which body 120 may be received and engaged on grip 112. Training device 110 is therefore always in the correct neutral position on putter 114. Training device 110 is engaged with putter 114 in a substantially identical manner as training device 10 is engaged with club 14, with the exception that the planar face 128*a* of body 120 is aligned with the planar face 114*a* of putter 114 before body 120 is slidingly moved along grip 112 in the direction of arrow "A" so as to become frictionally engaged therewith.

Body 120 of training device 110 is configured to correctly position the hands, fingers and thumbs of the golfer on grip 112. To that end, body 120 is provided with a protrusion 132 proximate proximal end 120*a* and a recessed region 135 adjacent thereto. Recessed region 135 is configured to receive the left thumb (not shown) of the golfer therein. Body 120 is further provided with first, second and third pads 136, 138 and 140 that are configured to respectively receive the right thumb, a portion of the right index finger and the tip of the right index finger therein. Each of these first, second and third pads 136, 138, 140 is positioned and oriented in substantially an identical location and manner to the first, second and third pads 36, 38 and 40 on training device 10.

Figure 21:
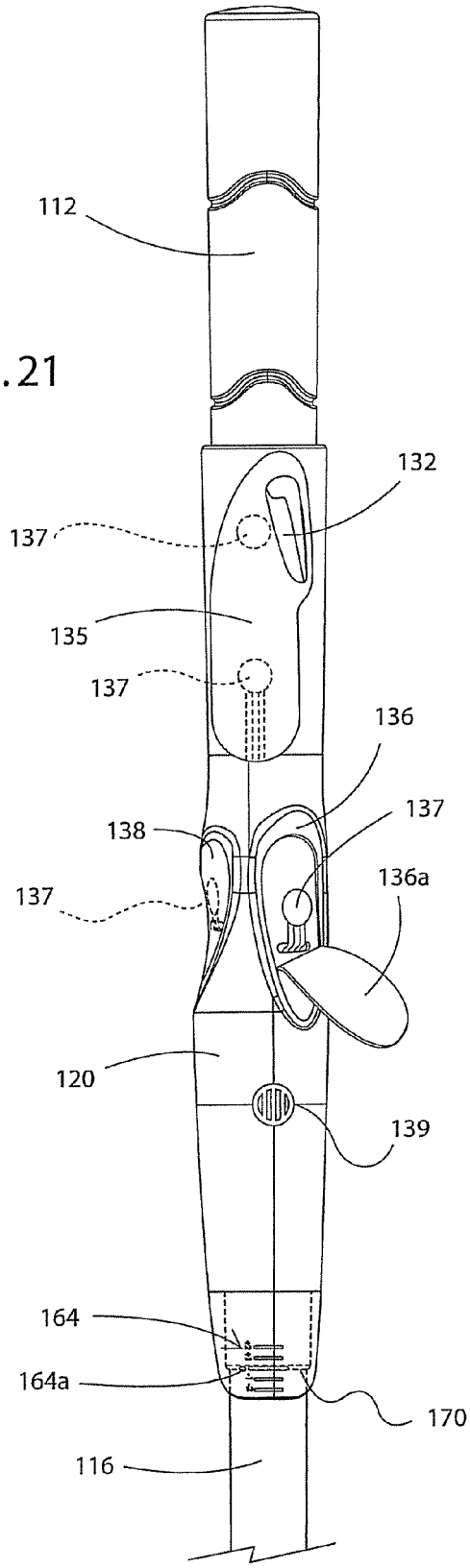
FIG. 21 is a front view of a second embodiment of a golf training device in accordance with the present invention and shown engaged with the handle of a golf putter. One of the rubber pads on the device is shown partially detached to reveal a pressure sensor disposed beneath the pad.
Figure 22:
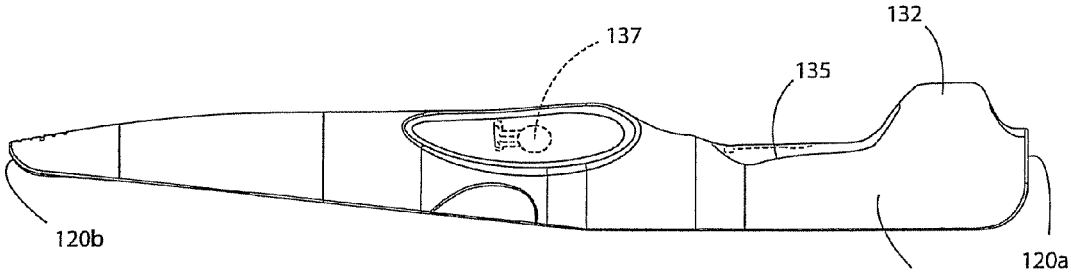
FIG. 22 is a left side view of the second embodiment of the golf training device in accordance with the present invention.
Figure 23:
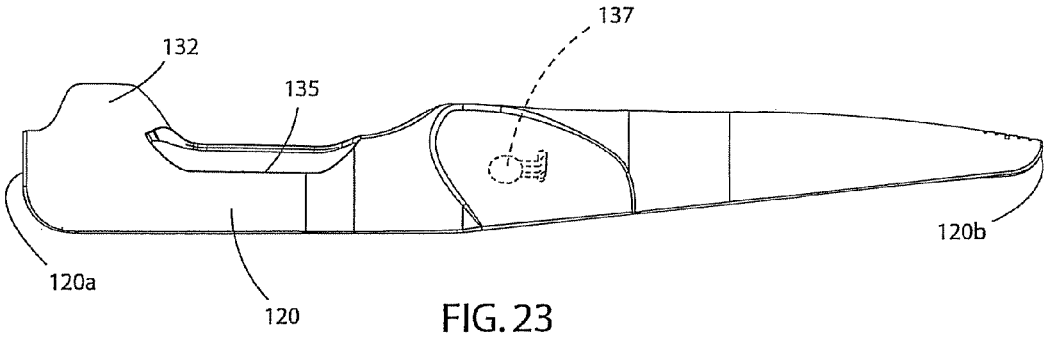
FIG. 23 is a right side view of the golf training device of FIG. 22.
Figure 24:
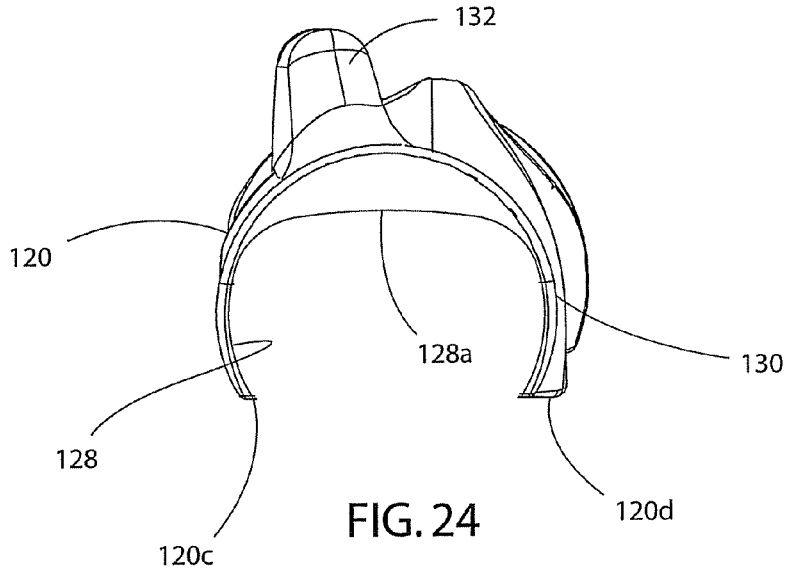
FIG. 24 is a rear view of the golf training device of FIG. 22.
Figure 25:
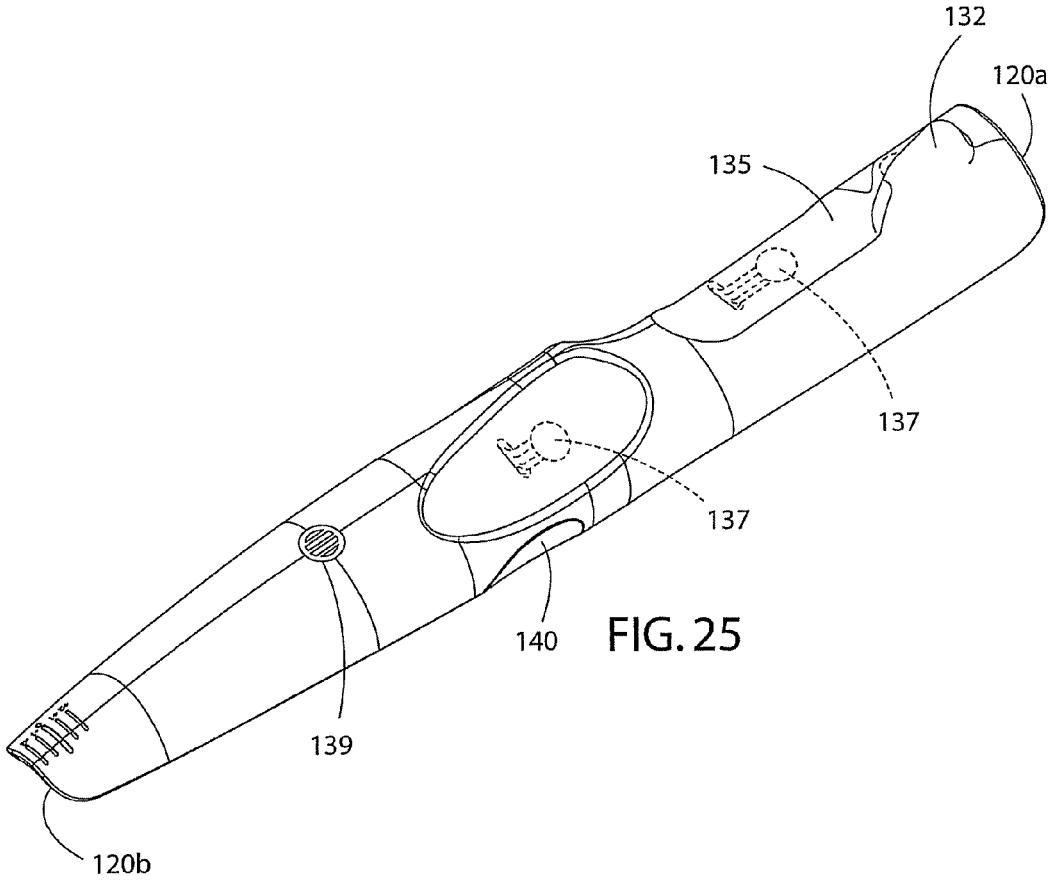
FIG. 25 is a perspective view of the training device of FIG. 22.

In accordance with a specific feature of the present invention, each of the recessed region 135 and first, second and third pads 136, 138, 140 are constructed in a similar manner to each other. Body 120 is molded from a flexible plastic as was the case with the first embodiment. However, each of recessed region 135, first, second and third pads 136, 138, 140 further includes a rubber overlayer that is secured to the plastic of body 120. FIG. 21 shows the rubber overlayer 136*a* of first pad 136 pulled away therefrom. In accordance with another specific feature of the present invention, each of recessed region 135 and first, second and third pads 136, 138, 140 is provided with a pressure sensor 137 that is positioned beneath the rubber overlayer. Each pressure sensor 137 is connected, either through hard wiring or through wireless connections, to a speaker 139. Pressure sensors 137 are preset so that if a predetermined threshold of pressure is detected that an audible sound will be emitted from speaker 139 to alert the golfer to adjust the strength of his grip on club 114.

As with the previous embodiment, training device 110 is provided with a clear pop-up member region 122 proximate distal end 120 thereof. Pop-up member region 122 differs from pop-up member 22 in that it is not articulated to body 120 and therefore cannot be pivoted relative thereto. Instead, pop-up member region 122 is fixedly coplanar with body 120. Pop-up member region 122 does not need to pivot, however, in that planar face 128*a* of body 120 complementary engages planar face 114*a* of putter 114 and thereby correctly orients training device 110 on putter 114. Training device 110 does, however, still need to be correctly positioned linearly on grip 112 relative to the axis "Y" of the putter 114. To that end, pop-up member region 122 is provided with a plurality of linear indicators 164 that are oriented at right angles to longitudinal axis "Y". When training device 110 is engaged on putter, the golfer slides body 120 along grip 112 and in the direction of arrow "A" until the primary linear indicator 164*a* is aligned with the inner end 170 of grip 112 and adjacent shaft 116 as previously described with respect to training device 10. Other of the indicator lines 64 may, however, be selected to alter the position of the hands relative to the linear axis of the putter 114.

Training device 110 is engaged with putter 114 and used in much the same manner as training device 10 on club 14. Finger pressure has been a long sought-after feature in golf training devices. It is difficult to determine where the center of the key gripping fingers and thumbs should be on grip 112. The training device 110 of the present invention is sized appropriately for the hand of the user. Training device 110 is manufactured for left-handed and right-handed adult males, left-handed and right-handed adult females, as well as for left-handed and right-handed male and female youths. The golfer simply has to select the appropriate size device and then the location of the various features of training device 110 will result in the golfer correctly gripping training device 110 and grip 112 in an accurate and repeatable fashion.

When golfer grips training device 110 around grip 112 of putter 114, pressure sensors 137 are activated. If, as mentioned previously, the incorrect pressure is applied to any one of the sensors 137, an audible sound is emitted from speaker 139 to alert the golfer to alter his grip on device 110. The sound(s) will be emitted from speaker 139 until the golfer adjusts his grip on device 110.

It will be understood that pressure sensors 137 and a recessed region 135 with a rubber overlay may be utilized instead of aperture 134 on training device 10 without departing from the spirit of the present invention. Similarly, it should be understood that an aperture may be provided in training device 110 without departing from the spirit of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A golf training device for engagement with a grip of a golf club to aid a golfer to perfect the position of their grip on the club, wherein said training device comprises:

an elongate member having:

a proximal end;

a distal end, whereby a longitudinal axis extends between the proximal and distal ends;

a first and a second side edge extending between the proximal and distal ends; said first and second side edges being separated from each other by a longitudinal gap;

an interior surface extending from the proximal end to the distal end and between the first and second side edges, said interior surface configured to abut the grip of a golf club;

an exterior surface opposed to the interior surface, said exterior surface being configured to be grippingly engaged by a golfer; and a first positioning aid on the elongate member for orienting the training device on the club, said first positioning aid extending outwardly from an exterior surface of the elongate member and at an angle to the longitudinal axis thereof; one or more indicator lines provided on the first positioning aid and being individually and visually alignable with a front face of the club; and wherein each one or more indicator lines represent an angle indicative of one of a neutral heel position, a negative heel position, and a positive heel position.

2. The training device as defined in claim 1, wherein the first positioning aid extends outwardly from the distal end of the elongate member.

3. The training device as defined in claim 2, wherein the first positioning aid is substantially transparent.

4. The training device as defined in claim 3, wherein the indicator includes at least one second indicator line that is disposed substantially at right angles to the longitudinal axis of the elongate member, said second indicator line being alignable with a lower end of the grip of the golf club during play.

5. The training device as defined in claim 4, further comprising a plurality of second indicator lines, each one of the plurality of second indicator lines being separately individually alignable with the lower end of the grip; and wherein said plurality of second indicator lines includes a primary second indicator line with one or more secondary second indicator lines adjacent a first side of the primary second indicator line; and one or more tertiary second indicator lines adjacent a second side of the primary second indicator line.

6. The training device as defined in claim 1, further comprising:

a second positioning aid provided on the elongate member and configured to correctly position at least one of the fingers, thumbs and hands of a golfer linearly and circumferentially on the club.

7. The training device as defined in claim 6, wherein the second positioning aid comprises a contoured region provided on the exterior surface of the elongate member and engageable by one of a thumb and a finger of the golfer.

8. The training device as defined in claim 7, wherein the contoured region extends upwardly and outwardly away from the exterior surface of the elongate member and is configured to have an inner side of the thumb of an upper hand of the golfer rest thereagainst.

9. The training device as defined in claim 8, wherein the second positioning aid further includes an aperture defined in the exterior surface of the elongate member adjacent the contoured region.

10. The training device as defined in claim 9, wherein the second positioning aid further comprises at least one pad provided on the exterior surface of the elongate member and a spaced distance from the aperture.

11. The training device as defined in claim 1, further comprising a pressure sensor incorporated into the elongate member.

12. The training device as defined in claim 11, wherein the exterior surface of the elongate member includes at least one groove, and wherein said pressure sensor is located in said at least one groove.

13. The training device as defined in claim 11, wherein the elongate member further includes a speaker that is operationally connected to said pressure sensor; and said speaker emits an audible sound when a pressure measured by the pressure sensor exceeds a predetermined limit.

14. The training device as defined in claim 1, wherein the the interior surface of the training device further comprises a substantially planar region that extends between the proximal and distal ends of said elongate member.

15. The training device as defined in claim 14, further comprising a pressure sensor incorporated into the elongate member.

16. The training device as defined in claim 15, wherein the exterior surface of the elongate member includes at least one groove and wherein said pressure sensor is located in said at least one groove.

17. The training device as defined in claim 15, wherein the elongate member further includes a speaker that is operationally connected to said pressure sensor; and said speaker is configured to emit an audible sound when a pressure measured by the pressure sensor exceeds a predetermined limit.

18. The training device as defined in claim 1, further comprising:

at least two second positioning aids provided on the elongate member, wherein a first one of the second positioning aids is configured to correctly position at least one of the fingers and thumb of a golfer's left hand linearly and circumferentially on the club; and a second one of the second positioning aids is configured to correctly position at least one of the fingers and thumb of the golfer's right hand linearly and circumferentially on the club.

19. The training device as defined in claim 1, further comprising a second positioning aid, wherein the second positioning aid comprises a contoured region provided on the exterior surface of the elongate member a spaced distance from the first positioning aid.

20. The training device as defined in claim 19, wherein the contoured region extends upwardly and outwardly away from the exterior surface of the elongate member.

21. The training device as defined in claim 20, wherein the second positioning aid further includes an aperture defined in the exterior surface of the elongate member adjacent the contoured region.

22. The training device as defined in claim 21, wherein the second positioning aid further comprises at least one pad provided on the exterior surface of the elongate member and a spaced distance from the aperture.

23. A golf training device, for engagement with a grip of a golf club, wherein said training device comprises:

an elongate member having:

a proximal end;

a distal end, whereby a longitudinal axis extends between the proximate and distal ends;

a first and a second side edge extending between the proximal and distal ends; said first and second side edges being separated from each other by a longitudinal gap;

an interior surface extending from the proximal end to the distal end and between the first and second side edges, said interior surface configured to abut the grip of a golf club;

an exterior surface opposed to the interior surface, said exterior surface being configured to be grippingly engaged by a golfer; and a first positioning aid on the elongate member, said first positioning aid having an indicator thereon that is configured to be visually aligned with a portion of the club; wherein the first positioning aid extends outwardly from the distal end of the elongate member; and wherein the first positioning aid comprises a pop-up member that is pivotally secured to the distal end of the elongate member; and said pop-up member is movable between a play position, where the pop-up member is substantially coplanar with the exterior surface of the elongate member; and a non-play position where the pop-up member extends outwardly away from the exterior surface of the elongate member and at an angle relative thereto.

24. The training device as defined in claim 23, wherein the pop-up member includes a plurality of spaced-apart first indicator lines that extend generally longitudinally therealong, and wherein said first indicator lines are configured to be individually selectively alignable with a front face of the golf club when the elongate member is rotated around a circumferential exterior surface of a grip of the club.

25. The training device as defined in claim 24, wherein said first indicator lines include:

a primary first indicator line that is substantially aligned along the longitudinal axis of the elongate member and configured to identify a neutral heel position;

at least one secondary first indicator line provided adjacent one of a first and a second side of the primary first indicator line, said secondary first indicator line extending outwardly at a first angle relative to the longitudinal axis of the elongate member and configured to identify a negative heel position; and at least one tertiary first indicator line provided adjacent the other of the first and second sides of the primary first indicator line, said tertiary first indicator line extending outwardly at a second angle relative to the longitudinal axis of the elongate member, said tertiary first indicator line being configured to identify a positive heel position.

26. The training device as defined in claim 25, wherein the first angle is less than zero degrees and up to −20 degrees.

27. The training device as defined in claim 25, wherein the second angle is more than zero degrees and up to +20 degrees.

28. The training device as defined in claim 23, wherein the pop-up member is disposed at an angle of substantially ninety degrees to the exterior surface of the elongate member when in the non-play position.

29. A training device for engagement with the grip of a golf club; said training device comprising:

an elongate member having:

a proximal end and a distal end with a longitudinal axis extending therebetween;

a first and a second side edge extending between the proximal and distal ends; said first and second side edges being separated from each other by a longitudinal gap;

an interior surface extending from the proximal end to the distal end and between the first and second side edges, said interior surface being complementary to at least a portion of an exterior longitudinal surface of the grip of the golf club;

an exterior surface opposed to the interior surface, said exterior surface being adapted to be grippingly engaged by a golfer;

a positioning aid for correctly positioning the training device on the grip; said aid comprising a movable member adjacently attached to the exterior surface of the elongate member; wherein said positioning aid includes an indicator thereon that is visually alignable with a front face of a head of the club, and wherein the indicator is one or more indicator lines provided on the first positioning aid and the indicator line or lines being individually and visually alignable with a front face of the club; wherein each one or more indicator lines represent an angle indicative of one of a neutral heel position, a negative heel position, and a positive heel position.

* * * * *

UNITED STATES PATENT AND TRADEMARK OFFICE

CERTIFICATE OF CORRECTION

PATENT NO. : 7,708,648 B2
APPLICATION NO. : 12/168617
DATED : May 4, 2010
INVENTOR(S) : Brunton et al.

It is certified that error appears in the above-identified patent and that said Letters Patent is hereby corrected as shown below:

Column 11, lines 36-37 (Claim 14) delete the duplicate "the" to change the phrase "where the the interior surface" to --wherein the interior surface--

Signed and Sealed this

Fifteenth Day of June, 2010

David J. Kappos

David J. Kappos
*Director of the United States Patent and Trademark Office*